United States Patent [19]

Hoshino et al.

[11] Patent Number: 4,849,166

[45] Date of Patent: Jul. 18, 1989

[54] HIGH STRENGTH STAINLESS STEEL

[75] Inventors: Kazuo Hoshino; Sadao Hirotsu; Sadayuki Nakamura, all of Yamaguchi, Japan

[73] Assignee: Nisshin Steel Company, Ltd., Tokyo, Japan

[21] Appl. No.: 243,452

[22] Filed: Sep. 12, 1988

Related U.S. Application Data

[63] Continuation-in-part of Ser. No. 870,824, Jun. 5, 1986, abandoned.

[51] Int. Cl.[4] ..... C22C 38/42

[52] U.S. Cl. ..... 420/58; 420/60

[58] Field of Search ..... 420/58, 60, 35, 50; 148/325

[56] References Cited

U.S. PATENT DOCUMENTS 3,785,787 1/1974 Yokota et al. ..... 420/58

4,378,246 3/1983 Hoshino et al. ..... 148/326

FOREIGN PATENT DOCUMENTS 2453109 5/1975 Fed. Rep. of Germany .

56-77364 6/1981 Japan .

62-50442 3/1987 Japan .

*Primary Examiner*—Deborah Yee

*Attorney, Agent, or Firm*—Webb, Burden, Ziesenheim & Webb

[57] ABSTRACT

There is disclosed a high strength stainless steel consisting essentially of not more than 0.10% C., more than 1.5% and not more than 2.95% Si, less than 0.5% Mn, not less than 4.0% and not more than 8.0% Ni, not less than 12.0% and not more than 18.0% Cr, not less than 0.5% and not more than 3.5% Cu, not more than 0.15% N and not more than 0.004% S, wherein the total content of C and N is not less than 0.10%, the balance is Fe and incidental impurities, said steel satisfies the relations $A' > 42$, and $35 < Md(N) < 95$, wherein $A' = 17 \times (C\ \% / Ti\ \%) + 0.70 \times (Mn\ \%) + 1\ x - (Ni\ \%) + 0.60 \times (Cr\ \%) + 0.76\ (Cu\ \%) - 0.063 \times (Al\ \%)$ and $Md(N) = 580 - 520\ (C\ \%) - 2\ (Si\ \%) - 16\ (Mn\ \%) - 16\ (Cr\ \%) - 23\ (Ni\ \%) - 300\ (N\ \%) - 26\ (Cu\ \%)$. This steel is inexpensive and can be provided with high strength and high ductility by cold working and aging.

3 Claims, 4 Drawing Sheets

HIGH STRENGTH STAINLESS STEEL

CROSS REFERENCE TO THE RELATED APPLICATION

This is a continuation-in-part application of Application Ser. No. 870,824 filed on June 5, 1986, now abandoned.

FIELD OF THE INVENTION

This invention relates to an austenitic-martensitic stainless steel which is suitable to be used as a material for parts and elements, in which high strength, high toughness, high ductility and corrosion resistance are required, such as thin leaf spring, thin plate coil, cutlery, cutting tool body, etc., and which is especially suitable as a material for parts in which high strength and high ductility are required.

BACKGROUND OF THE INVENTION

For manufacturing the above-mentioned parts and elements, martensitic stainless steels, work-hardenable austenitic stainless steels, precipitation-hardenable stainless steels, etc. have conventionally been used.

Martensitic stainless steels are hardened by quenching from the austenitic state at an elevated temperature to cause martensitic transformation. Steels of SUS 410, 410J, 420J1, 420J2, 440A, 440B, 440C, etc. are typical examples of these steels, which have conventionally been used. Although these steels are low in strength and toughness in the annealed state, considerably high strength and toughness are attained by quenching and tempering. Therefore, these steels are widely used as inexpensive materials.

However, as martensitic stainless steels are not satisfactory for use in which high corrosion resistance is required, in such a field, work-hardenable austenitic stainless steels are used. These steels are Cr-Ni austenitic steels which are in the metastable state at ordinary temperatures and are hardened by cold rolling. The hardened steels are of two phases consisting of austenitie and martensite and therefore excellent in strength and ductility and also excellent in corrosion resistance. Typical examples of these steels are SUS 301, 304, etc. The strength of these steels depends upon the degree of cold working as stipulated in JIS G4313 and intensive cold working is required in order to attain high strength.

Precipitation-hardenable stainless steels contain precipitation-hardening elements and are hardened by heat-treatment, and therefore afford articles of good shape. Therefore, these steels are employed when shape requirements of products are strict and corrosion resistance is an important factor.

Typical examples of these steels are SUS 630, which contains Cu, and SUS 631, which contains Al. The former is hardened by solution treatment followed by aging during which a Cu-rich phase is precipitated. But the hardness thereof is 140 kgf/mm$^2$ at the highest. The latter is hardened by first subjecting to solution treatment, then transforming tbe metastable austenite phase partly or wholly to the martensite phase by cold working, for instance, and thereafter precipitating a $Ni_3Al$ intermetallic compound by aging. This can provide considerably high strength materials.

As a method for transforming the austenite phase of SUS 631 to martensite phase and then aging it, treatments such as TH 1050, RH 950, CH, etc. can be resorted to. But the strength attained by the former two treatments is 130 kgf/mm$^2$ at the highest, while a strength as high as 190 kgf/mm$^2$ can be attained by the CH treatment. In the CH treatment, the steel is first subjected to cold working to convert the austenite phase to the austenite-martensite two phases as in the case of work-hardenable stainless steels, and is thereafter subjected to aging. The strength after the cold working is around 150 kgf/mm$^2$, depending on the degree of cold working. But the above-mentioned high strength is attained by precipitation of the $Ni_3Al$ intermetallic compound when the steel is age-hardened.

Of the above-described stainless steels, martensitic stainless steels must be subjected to quenching and tempering in order to attain strength and toughness. The heat treatments are troublesome. In quenching, materials are heated to a high temperature (950°–1100° C.), wherefrom they are quenched. Rapid mertensitic transformation deteriorate shape of treated articles. In order to prevent such trouble, a special heat treatment such as press-quenching is required.

In the case of austenitic stainless steels, high degree cold working is required in order to attain high strength. But if high strength is attained, ductility is sacrificed, and the shape of sheet products and strip products is often deteriorated.

Further, in the case of precipitation-hardenable stainless steels, SUS 630 does not attain high strength, and SUS 631 often devlops surface roughness and is impaired in toughness and ductility because the steel contains 0.75–1.50% Al which has a strong affinity for oxygen and nitrogen, and alumina type inclusions are formed during the steel-making and coagulated inclusions of AlN are formed when the steel is cast.

Japanese Laid-open Patent Publication No. 52-007317 disclose a steel substantially contained in % by weight, C: ≦0.02%, S: ≦1.00%, Mn: ≦2.00%, P: ≦0.040%, S: ≦0.003%, Ni: 5.00–8.50%, Cr: 16.00–21.00%, Cu: 0.50–4.00%, N: <0.20%, O: ≦0.015% and the balance being Fe and unavoidable impurities. This steel is for compression forming and, therefore work-hardenability and formation of martensite are restricted by reducing C content, increasing N and adding Cu and reducing Si. That is, hardness of the resulting products are not satisfactory.

Japanese Laid-Open Patent Publication No. 56-077364 discloses a steel comprising, by weight C: ≦0.15%, N: ≦0.15%, Si: 0≦1.5%, Mn: 0.5–2.0%, Ni: 5.0–9.0%, Cr: 13.0–20.0%, Cu: 1.0–4.0%, and the balance being Fe and unavoidable impurities and having the $Md_{(30)}$ (°C.) value of −30°–80° C., said $Md_{(30)}$ (°C.) being defined as $$Md_{(30)}\,(°C.) = 551 - 462(\%\,C + \%\,N) - 9.2(\%\,Si) - 8.1(\%\,Mn) - 29(\%\,Ni + \%\,Cu) - 13.7(\%\,Cr).$$

The $Md_{(30)}$ (°C.) is the temperature at which 30% cold-worked super-cooled austenite transforms into martensite of 50% and represents austenite stability (instability). This steel is intended for a spring material as well as the present invention. However, this steel is not satisfactory in the balance of strength and elongation. This is because the Mn content is rather high, the Si content is rather low and S is not restricted.

U.S. Pat. No. 4,378,246 by the inventors including two of the inventors of the present invention discloses a martensitic precipitation-hardening type stainless steel for spring comprising in % by weight more than 0.03% but not more than 0.08% of C, 0.3 to 2.5% of Si, not more than 4.0% of Mn, 5.0 to 9.0% of Ni, 12.0 to 17.0% of Cr, 0.1 to 2.5% of Cu, 0.2 to 1.0% of Ti and not more than 1.0% of Al, the balance being Fe and having a specifically defined restricted austenite stability A' of less than 42, said A' being defined as $$A' = 17 \times (C\,\%/Ti\,\%) + 0.70 \times (Mn\,\%) + 1 \times (Ni\,\%) + 0.60 \times (Cr\,\%) + 0.76 \times (Cu\,\%) - 0.63 \times (Al\,\%) + 20.871,$$

having a specifically defined Cr equivalent/Ni equivalent ratio of not more than 2.7, said ratio being defined as $$Cr\ eq./Ni\ eq. = \{(1 \times (Cr\,\%) + 3.5 \times (Ti\,\% + Al\,\%) + 1.5 \times Si\,\%\}/\{1 \times (Ni\,\%) + 0.3 \times (Cu\,\%) + 0.65 \times (Mn\,\%)\}$$

and further having a specifically defined hardness increase by aging ΔHv of between 120 and 210, said ΔHv being defined as $$\Delta Hv = 205 \times [Ti\,\% - 3 \times (C\,\% + N\,\%)] + 205 \times [Al\,\% - 2 \times (Ni\,\%)] + 57.5 \times (Si\,\%) + 20.5 \times (Cu\,\%) + 20.$$

This steel is genuinely martensitic precipitation-hardenable steel. The fact is represented by the A' value less than 42, the rather high Mn content and addition of precipitate-forming elements such as Ti and Al. The A' value is an index which represents existence of the residual austenite after solution treatment. When this value is less than 42, the steel is simply martensitic.

It is not that ductility is not considered as the upper limit of ΔHv is somewhat restricted. However, ductility of this steel is not sufficient.

DISCLOSURE OF THE INVENTION

The present invention intends to provide a new steel material of a type different from the above-described. That is, this invention provides a stainless steel which has good workability and is hardened by work-hardening of austenite and formation of minute work-induced martensite and further hardened by aging, probably strain aging accompanied by some precipitaion.

This invention provides a high strength stainless steel essentially consisting of not more than 0.10% C., more than 1.5% and not more than 2.95% Si, less than 0.5% Mn, not less than 4.0% and not more than 8.0% Ni, not less than 12.0% and not more than 18.0% Cr, not less than 0.5% and not more than 3.5% Cu, not more than 0.15% N and not more than 0.004% S, wherein the total content of C and N is more than 0.10%, the balance being Fe and incidental impurities including up to 0.020% Al and up to 0.020% Ti, and the A' value as defined below is 50–150 and the Md(N) as defined below is 35–95.

$$A' = 17 \times (C\,\%/Ti\,\%) + 0.70 \times (Mn\,\%) + 1 \times -(Ni\,\%) + 0.60 \times (Cr\,\%) + 0.76 \times (Cu\,\%) - 0.63 \times (Al\,\%) + 20.871$$

$$Md(N) = 580 - 520(C\,\%) - 2(Si\,\%) - 16(Mn\,\%) - 16(Cr\,\%) - 23(Ni\,\%) - 300(N\,\%) - 26(Cu\,\%)$$

The steel of this invention contains Si, which is a martensite inducer and martensite strengthener, in a larger amount of more than 1.5% and not more than 2.95% than the conventional steel; and it contains C and N, which are martensite phase strengtheners, in an amount of not less than 0.10% in total. Therefore, the martensite phase is easily induced from the metastable austenite after the solution treatment by light cold working because of the presence of the high level of Si; and the thus induced martensite phase is hardened by Si, C and N and thus products of good shape, high strength and high ductility can be obtained. And as a precipitation hardening element, Cu, which acts synergistically with Si and with which there is no risk of inclusion formation, is added, and aging is additionally carried out, and thus a higher strength is attained. Therefore, the steel of this invention can be used as a work-hardenable stainless steel which is superior to the conventional steel in strength and ductility an also can be used as a precipitation-hardenable stainless steel.

Now the reason why the composition is defined as stated above is explained.

C is an austenite former and is effective for inhibiting formation of δ-ferrite at high temperature and strengthening the martensite phase induced by cold working. But the solution limit of C is restricted because of high Si content in the steel of this invention. Therefore, a high carbon content will cause deposition of chromium carbides at grain boundaries, which will induce abatement of ductility and resistance to intergranular corrosion. Therefore, the C content is limited to 0.10%.

Si is used usually as a deoxidizer. For this purpose, the Si content is not more than 1.0% as seen in work-hardenable austenitic stainless steels such as SUS 301, 304, etc., and precipitation hardenable stainless steel such as SUS 631. In the case of the steel of this invention, however, Si is contained in a higher amount than this, that is, more than 1.5%, so that the martensite phase is easily induced in cold working, that is, it is induced even by slight cold working and the formation thereof is promoted and the ratio of martensite phase to austenite phase is enhanced. The formed martensite is not only strengthened but it is dissolved in the remaining austenite phase to harden it and thus the hardness after working is enhanced. Also, in aging Si increases the aging effect in combination with Cu. As stated above, Si has many effects. In order to make Si exhibit such effects, Si must be contained in an amount of more than 1.5%, higher than the conventional content range. But if it exceeds about 3.0%, it induces high temperature cracking and causes some problems in manufacturing. More than 1.5% and not more than 2.95% is a suitable content.

Mn is an element which controls the stability of the austenite phase. The content is determined by taking into consideration the balance with the other elements. In the steel of the present invention, a higher content of Mn will cause abatement of ductility and also causes some problems when the steel is used. For this reason the Mn content is limited to 0.5%, rather remarkably lower than the conventional range.

Ni is an essential element for the formation of an austenite phase at both high temperatures and room temperature. In the case of the steel of this invention, metastable austenite must exist at room temperature and must be transformed into martensite phase by cold working. For this purpose, with less than 4.0% Ni, a large amount of δ-ferrite is formed at a higher temperature and the austenite phase becomes rather unstable than metastable at room temperature. On the other hand, with more than 8.0% Ni, the martensite phase is not easily induced by cold working. Therefore the Ni content is selected as 4.0–8.0%.

Cr is an essential element for obtaining corrosion resistance. In order to provide the steel with desired corrosion resistance, not less than 12% of Cr is required. But Cr is a ferrite former. If a higher amount of Cr is contained, a large amount of δ-ferrite is formed at high temperatures. Therefore, a correspondingly larger amount of austenite former elements (C, N, Ni, Mn, Cu, etc.) must be contained to inhibit formation of the δ-ferrite. And if large amounts of the austenite formers are contained, the austenite is in turn stabilized at room temperature and the steel is not hardened by cold working and aging. As such, the upper limit of the Cr content is defined as 18.0%.

Cu hardens the steel in aging in combination with Si. With too small an amount, the effect thereof is not remarkable and if too large an amount thereof is contained, it causes cracking. The proper amount is estimated as 0.5–3.5%.

N is an austenite former and is very effective for hardening both austenite phase and martensite phase. However, if N is contained in high amounts, it may cause blow holes when the steel is cast. Therefore, the N content is limited to not more than 0.15%.

S forms MnS in the presence of Mn, and brings about abatement of ductility and therefore it is an especially deleterious element in the steel of this invention. The upper limit thereof is restricted to 0.004% in order to avoid abatement of ductility.

C and N have similar effects and are interchangeable. Although the respective upper limits for these elements are as defined above, the total amount of these two elements must be not less than 0.10% to utilize their effect.

In addition to the above-mentioned elements, a slight residual amount of Al and Ti, which are used as deoxidizers, Ca and REM's (rare earth metals) which are used as desulfurizer, etc. and incidental inevitable impurities such as P are permitted to be present in the steel of the present invention. The steel of this invention is allowed to contain not more than 0.020% of Al, not more than 0.020% of Ti, although these elements are undesirable because they form non-metallic inclusions which impair ductility. Not more than 0.040% of P, not more than 0.01% of Ca and not more than 0.02% of REM's are allowed.

Preferably, the high strength stainless steel of this invention contains not more than 0.08% C, more than 1.5% and not more than 2.95% Si, less than 0.46% Mn, not less than 4.5% and not more than 7.5% Ni, not less than 14.0% and not more than 17.0% Cr, not less than 0.8% and not more than 3.0% Cu, not more than 0.13% N and not more than 0.0035% S.

More preferably, the high strength stainless steel of this invention contains not more than 0.075% C, more than 1.5% and not more than 2.95% Si, less than 0.42% Mn, not less than 5.50% and not more than 7.30% Ni, not less than 14.5% and not more than 16.5% Cr, not less than 1.00% and not more than 2.65% Cu, not more than 0.125% N and not more than 0.003% S.

In any case, the total content of C and N should be not less than 0.10%.

The above-mentioned A′ value as defined in the same way as in U.S. Pat. No. 4,378,246 must be more than 42. In the present invention the A′ value is calculated with the Ti and Al contents as 0.02% respectively. The A′ value as defined above is simply referred to in order to distinguish the steel of the present invention from that of U.S. Pat. No. 4,378,246, although the thus defined A′ value is not inherently applicable to the steel of the present invention.

The Md(N) is an index which represents austenite stability at room temperature (25° C.). The smaller this value, the more stable the austenite. Therefore, as the value is larger, more martensite is formed. If this value is less than 35, the resulting age-hardened steel material is insufficient in hardness. When this value exceeds 95, the resulting steel material is insufficient in ductility.

BRIEF EXPLANATION OF THE DRAWINGS

The invention will now be described by way of working examples with reference to the attached drawings.

DETAILED DESCRIPTION OF THE INVENTION

Figure 1:
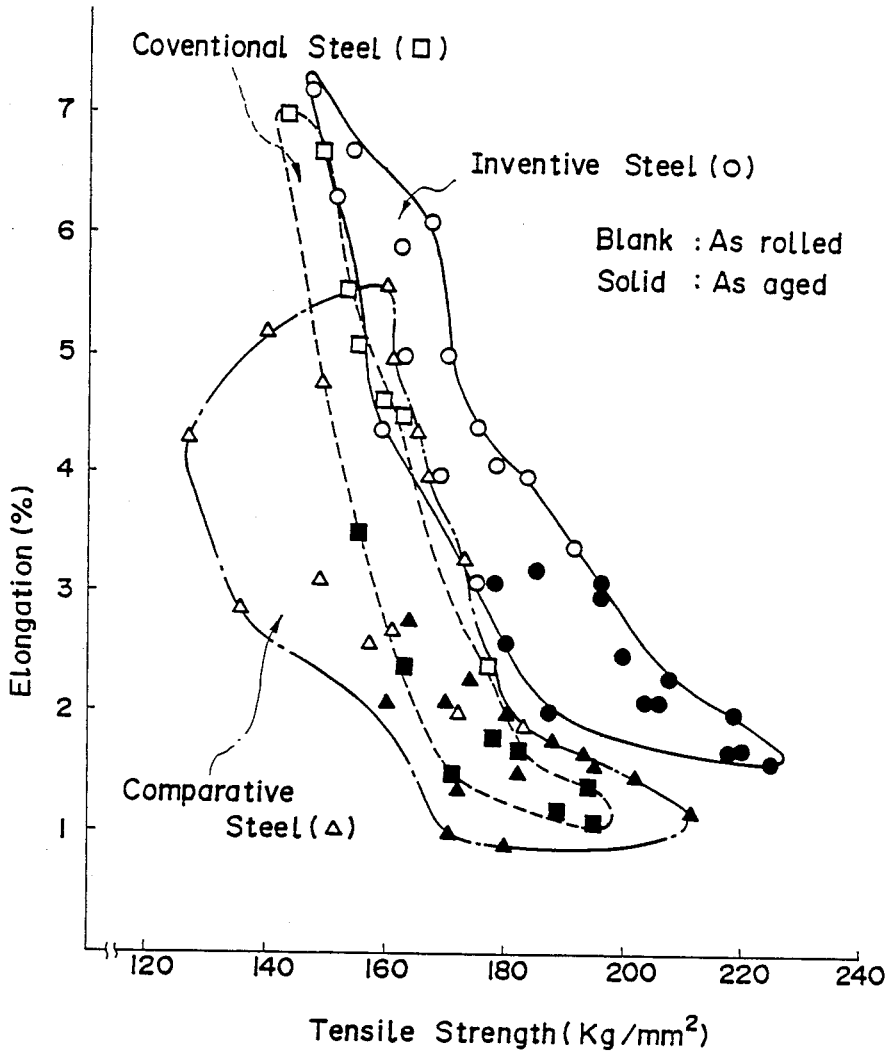
FIG. 1 shows the relation between tensile strength and elongation of the steels of this invention (hereinafter called "inventive steels"), conventional steels and comparative steels in the cold-rolled state and age-hardened state. The circle, square and triangle symbols denote respectively the inventive steels, conventional steels and comparative steels. Blank symbols denote the cold-rolled state and solid black ones the age-hardened state. The solid line, broken line and one-dot chain line indicate respectively the data distributions of the inventive steels, conventional steels and comparative steels.
Figure 2:
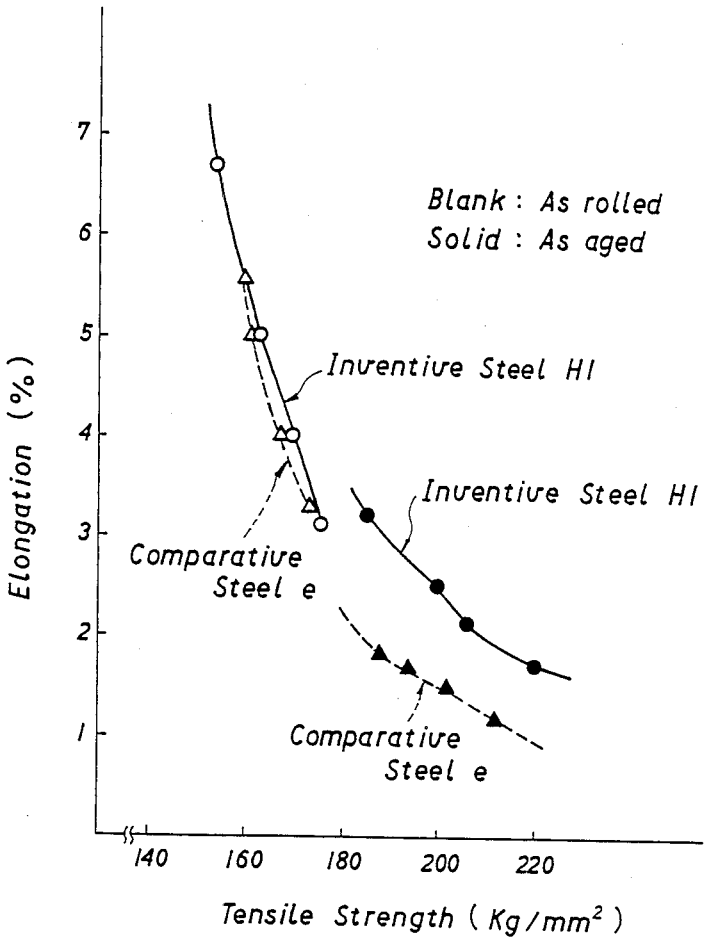
FIG. 2 shows the relation between tensile strength and elongation of Inventive Steel H1 and Comparative Steel e.

Inventive steels (H1–H4), conventional steels (A–C) and comparative steels (a–f) of the compositions as shown in Table 1 were prepared and hot-rolled by the usual method, and they were cold-rolled with varied degrees of reduction to form high strength cold-rolled steel sheet samples. The calculated A′ values and Md(N) values are indicated in Table 1. A′ values were calculated with the Ti and Al contents as 0.02% respectively. The amount of the martensite induced by cold working (α), hardness, tensile strength and elongation of the thus made steel sheet samples were measured. Then these high strength cold-rolled steel sheets were age-hardened, and hardness, tensile strength and elongation were measured. The results are shown in Table 2, wherein the difference in the hardness before and after aging (ΔHv) is also indicated. Of the results as shown in Table 2, the relation between tensile strength and elongation is shown in FIG. 1. Further, the relation between tensile strength and elongation of Inventive Steel H1 and Comparative Steel e, which is close to the inventive steels in properties in the cold-rolled state is shown in FIG. 2.

As is apparent from Table 2, the amounts of the induced martensite ($\alpha$) of the inventive steels are larger than those of the conventional steels at the same reduction, since martensite is more easily induced by cold rolling in the inventive steels. In the inventive steels, more martensite is produced with less reduction.

As is apparent from FIG. 1, the inventive steels have a higher tensile strength and elongation than the conventional and comparative steels, both in the cold-rolled state and in the aged state, and show a remarkable increase in tensile strength by aging. That is to say, the inventive steels are superior to conventional work-hardenable austenitic stainless steels and precipitation-hardenable stainless steels in tensile strength and elongation both when they are used in the cold-rolled state and when they are used in the aged state. As the degree of cold-rolling can be reduced, good shape can be attained.

It will be apparent from a comparison of Table 1 and Table 2 that greater values of $\Delta Hv$ are obtained in steels in which Si and Cu co-exist. It is understood that the age-hardening is caused by the synergistic action of Si and Cu.

It is apparent from FIG. 2 that Comparative Steel e which contains higher amounts of Mn and S is inferior to the inventive steels in elongation at the strength level after age-hardening. It is understood that ductility is inferior when the steel contains Mn and S in higher amounts.

TABLE 1

| | Elements (%) | | | | | | | | | | | | |
|---|---|---|---|---|---|---|---|---|---|---|---|---|---|
| | C | Si | Mn | S | Ni | Cr | N | Cu | Al | Remarks | Ms (°C.) | Md (N) | A' value |
| Inventive Steels | | | | | | | | | | | | | |
| H1 | 0.028 | 2.67 | 0.46 | 0.002 | 6.50 | 15.88 | 0.103 | 1.75 | — | | −61.6 | 73 | 62.3 |
| H2 | 0.059 | 2.72 | 0.42 | 0.001 | 6.56 | 15.97 | 0.099 | 1.74 | — | | −114.0 | 56 | 88.8 |
| H3 | 0.075 | 2.49 | 0.22 | 0.002 | 5.93 | 15.80 | 0.125 | 2.43 | — | | −125.4 | 43 | 102.0 |
| H4 | 0.042 | 2.18 | 0.36 | 0.002 | 5.85 | 15.10 | 0.098 | 2.65 | — | | 12.6 | 74 | 73.7 |
| Conventional Steels | | | | | | | | | | | | | |
| A | 0.105 | 0.52 | 1.05 | 0.004 | 7.09 | 16.82 | 0.025 | 0.05 | — | SUS301 | −95.1 | 66.7 | 128.0 |
| B | 0.120 | 0.50 | 1.13 | 0.006 | 7.54 | 17.50 | 0.015 | 0.07 | — | " | −161.23 | 38.8 | 141.7 |
| C | 0.085 | 0.41 | 0.57 | 0.005 | 7.39 | 16.72 | 0.011 | 0.05 | 1.18 | SUS631 | −33.5 | 83.7 | 110.2 |
| Comparative Steels | | | | | | | | | | | | | |
| a | 0.013 | 2.69 | 0.30 | 0.008 | 9.91 | 12.01 | 0.016 | 1.70 | — | | 66.1 | 93.97 | 50.5 |
| b | 0.027 | 2.01 | 0.42 | 0.005 | 7.96 | 14.93 | 0.061 | 0.91 | — | | −19.9 | 91.3 | 61.1 |
| c | 0.104 | 0.28 | 1.00 | 0.007 | 6.59 | 16.07 | 0.017 | 1.79 | — | | −9.9 | 49.0 | 127.6 |
| d | 0.063 | 0.22 | 1.00 | 0.006 | 6.60 | 15.68 | 0.062 | 1.80 | — | | 0.7 | 62.7 | 92.5 |
| e | 0.074 | 2.78 | 1.47 | 0.008 | 5.59 | 15.43 | 0.061 | 1.92 | — | | −30.6 | 68.8 | 101.1 |
| f | 0.071 | 2.83 | 2.10 | 0.002 | 7.91 | 13.40 | 0.086 | 0.03 | — | | −146.8 | 80.9 | 98.7 |

TABLE 2

| | | | | As rolled | | | As aged 400° C. × 1 hr | | | |
|---|---|---|---|---|---|---|---|---|---|---|
| | Sample No. | Reduction (%) | $\alpha$ (%) | H'dness Hv (10) | T.S. (kg/mm$^2$) | El. (%) | H'dness Hv (10) | T.S. (kg/mm$^2$) | El. (%) | $\Delta Hv$ |
| Inventive steels | H1 | 40 | 63.0 | 455 | 154 | 6.7 | 547 | 185 | 3.2 | 92 |
| | | 45 | 68.5 | 469 | 163 | 5.0 | 568 | 200 | 2.5 | 99 |
| | | 50 | 72.0 | 488 | 169 | 4.0 | 589 | 206 | 2.1 | 101 |
| | | 55 | 74.5 | 500 | 175 | 3.1 | 599 | 220 | 1.7 | 96 |
| | H2 | 40 | 63.5 | 481 | 167 | 6.1 | 580 | 196 | 3.1 | 99 |
| | | 45 | 64.5 | 502 | 175 | 4.4 | 601 | 208 | 2.3 | 99 |
| | | 50 | 67.0 | 520 | 183 | 4.0 | 612 | 219 | 2.0 | 92 |
| | | 55 | 69.5 | 534 | 191 | 3.4 | 628 | 225 | 1.6 | 94 |
| | H3 | 45 | 43.5 | 469 | 162 | 5.9 | 571 | 196 | 3.0 | 102 |
| | | 50 | 49.0 | 490 | 170 | 5.0 | 595 | 205 | 2.1 | 105 |
| | | 55 | 54.0 | 511 | 178 | 4.1 | 619 | 219 | 1.7 | 108 |
| | H4 | 45 | 45.5 | 428 | 147 | 7.2 | 526 | 178 | 3.1 | 98 |
| | | 50 | 51.5 | 440 | 151 | 6.3 | 541 | 180 | 2.6 | 101 |
| | | 55 | 57.3 | 456 | 159 | 4.4 | 551 | 187 | 2.0 | 95 |
| Conventional steels | A | 45 | 39.5 | 440 | 149 | 6.7 | 467 | 155 | 3.5 | 27 |
| | | 50 | 43.5 | 451 | 155 | 5.1 | 490 | 163 | 2.4 | 39 |
| | | 55 | 47.0 | 465 | 162 | 4.5 | 503 | 171 | 1.5 | 38 |
| | B | 55 | 32.5 | 464 | 161 | 4.5 | 506 | 178 | 1.8 | 40 |
| | | 60 | 45.0 | 504 | 177 | 2.4 | 544 | 194 | 1.4 | 40 |
| | C* | 45 | 44.5 | 420 | 143 | 7.0 | 520 | 182 | 1.7 | 100 |
| | | 50 | 49.0 | 445 | 153 | 5.6 | 549 | 189 | 1.2 | 104 |
| | | 55 | 58.0 | 451 | 159 | 4.6 | 558 | 195 | 1.1 | 107 |
| Comparative Steels | a | 50 | 43.0 | 379 | 127 | 4.3 | 476 | 160 | 2.1 | 95 |
| | | 60 | 55.5 | 410 | 136 | 2.9 | 506 | 171 | 1.0 | 96 |
| | b | 50 | 56.0 | 415 | 140 | 5.2 | 482 | 164 | 2.8 | 67 |
| | | 60 | 65.0 | 441 | 149 | 3.1 | 507 | 172 | 1.4 | 66 |
| | c | 50 | 60.5 | 473 | 165 | 4.4 | 514 | 180 | 2.0 | 43 |
| | | 60 | 69.0 | 500 | 183 | 1.9 | 542 | 195 | 1.6 | 42 |
| | d | 50 | 67.0 | 444 | 157 | 2.6 | 503 | 174 | 2.3 | 59 |
| | | 60 | 76.0 | 459 | 172 | 2.0 | 516 | 182 | 1.5 | 57 |
| | e | 40 | 48.0 | 459 | 160 | 5.6 | 549 | 188 | 1.8 | 90 |
| | | 45 | 50.5 | 473 | 162 | 5.0 | 558 | 194 | 1.7 | 85 |
| | | 50 | 55.5 | 486 | 167 | 4.0 | 580 | 202 | 1.5 | 94 |
| | | 55 | 59.5 | 499 | 173 | 3.3 | 592 | 212 | 1.2 | 93 |
| | f | 50 | 46.5 | 447 | 149 | 4.8 | 500 | 170 | 2.1 | 53 |

TABLE 2-continued

| Sample No. | Reduction (%) | α (%) | As rolled H'dness Hv (10) | As rolled T.S. (kg/mm²) | As rolled El. (%) | As aged 400° C. × 1 hr H'dness Hv (10) | As aged 400° C. × 1 hr T.S. (kg/mm²) | As aged 400° C. × 1 hr El. (%) | ΔHv |
|---|---|---|---|---|---|---|---|---|---|
| | 60 | 54.0 | 479 | 161 | 2.7 | 528 | 180 | 0.9 | 49 |

*Conventional Steel C was aged at 480° C. for 1 hour.

Incidentally, ΔHv values of Conventional Steel C and Comparative steel a are high. But tensile strength in the cold-rolled state of these steels is not high and therefore the increase in tensile strength by aging is not so large. The high ΔHv value of Comparative Steel C is based on precipitation of the intermetallic compound $Ni_3Al$.

For the sake of comparison, we reproduce Table 1 of U.S. Pat. No. 4,378,246 here as Table 3 in which Ms(°C.) values and Md(N) values are incorporated.

As seen in Table 1 and 3, the Md(N) values of the steels % U.S. Pat. No. 4,378,246 are more than 100, while those of the present invention are 43–74 in the indicated working examples.

Further, we carried out the following experiment. Steels of the present invention and those of similar compositions, which are indicated in Table 4, were prepared in the same manner as described above and the cold-rolled sheets were subjected to aging at 400° C. for 1 hour and mechanical properties were measured. The results are illustrated in FIGS. 3, 4 and 5.

Figure 3:
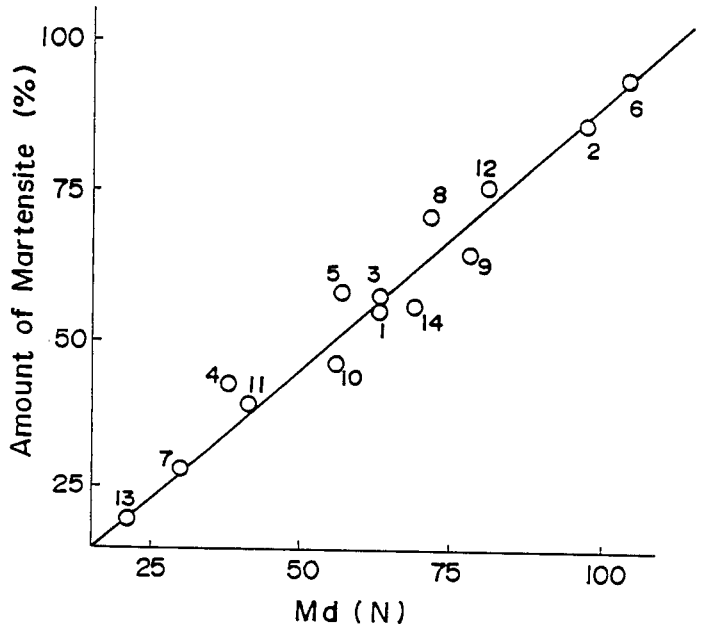
FIG. 3 is a graph representing the relation between the amount of the work-induced martensite and the Md(N) value of inventive steels and similar steels.

FIG. 3 shows the relation between the Md(N) value and the amount of martensite formed from austenite. As seen there, the two are in the linearly proportional relation.

Figure 4:
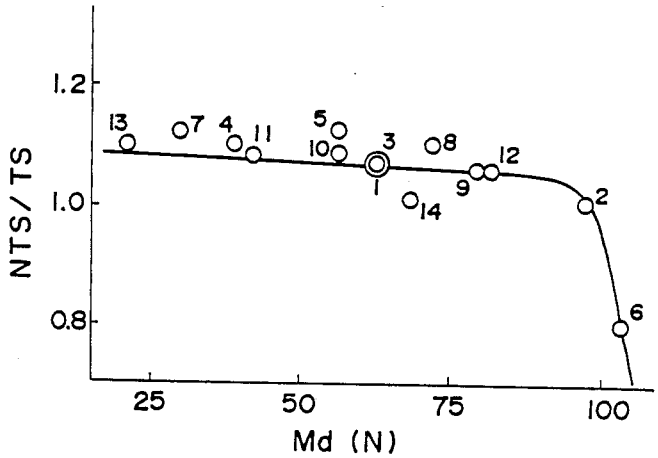
FIG. 4 is a graph representing the relation between the ratio of notch tensile strength (NTS)/tensile strength (TS) and the Md(N) value of inventive steels and similar steels.
Figure 5:
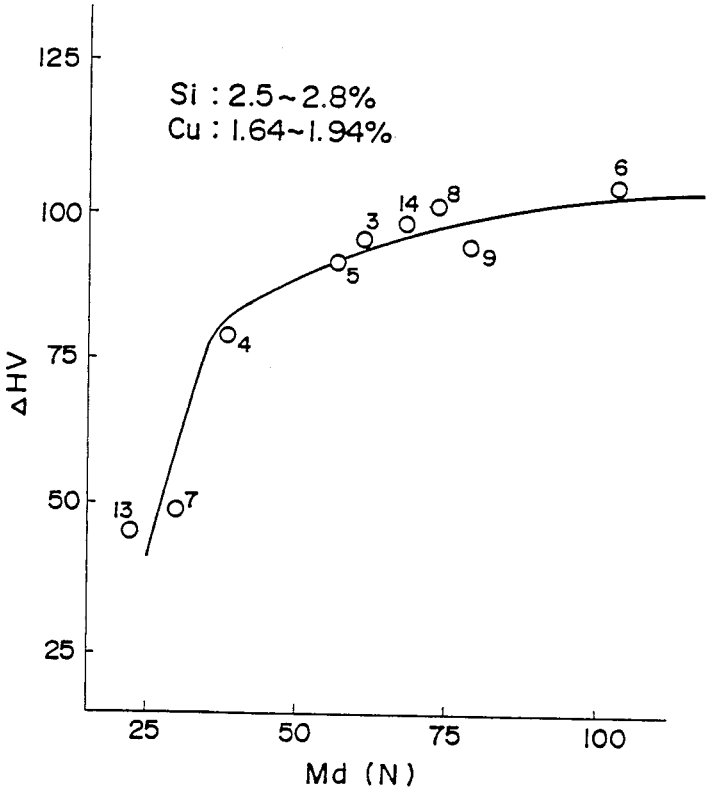
FIG. 5 is a graph representing the relation between the ΔHv value and the Md(N) of the invention steels and similar steels.

FIG. 4 shows the relation between the Md(N) value and the NTS (notch tensile strength)/TS (tensile strength) ratio. Said ratio is an index of toughness. FIG. 4 tells that when Md(N) exceeds 95, said ratio precipitously drops.

TABLE 3

| | Specimen No. | C | Si | Mn | Ni | Cr | Cu | Ti | Al | N | A' value | Cr equ. / Ni equ. | Hv Value | Ms (°C.) | Md (N) |
|---|---|---|---|---|---|---|---|---|---|---|---|---|---|---|---|
| Steels of U.S. Pat. No. 4,378,246 | 1 | 0.033 | 1.45 | 0.31 | 7.40 | 14.90 | 1.00 | 0.34 | 0.020 | 0.015 | 39.83 | 2.32 | 162 | 101.5 | 115 |
| | 2 | 0.047 | 0.65 | 1.00 | 6.70 | 14.50 | 0.51 | 0.32 | 0.45 | 0.009 | 39.57 | 2.42 | 188 | 146.8 | 136 |
| | 3 | 0.034 | 1.52 | 0.29 | 7.01 | 14.77 | 0.61 | 0.28 | 0.025 | 0.015 | 39.46 | 2.45 | 146 | 127.8 | 137 |
| | 4 | 0.048 | 1.51 | 0.30 | 7.10 | 14.52 | 1.70 | 0.26 | 0.018 | 0.013 | 41.31 | 2.28 | 156 | 112.7 | 104 |
| | 5 | 0.032 | 1.53 | 0.31 | 7.07 | 14.55 | 0.51 | 0.49 | 0.030 | 0.010 | 38.37 | 2.51 | 195 | 144.0 | 143 |
| | 6 | 0.044 | 1.53 | 0.30 | 7.21 | 14.70 | 0.70 | 0.43 | 0.020 | 0.008 | 39.37 | 2.44 | 179 | 112.9 | 128 |
| | 7 | 0.045 | 0.34 | 2.50 | 6.21 | 14.50 | 0.30 | 0.95 | 0.021 | 0.012 | 38.55 | 2.32 | 205 | 133.7 | 120 |
| | 8 | 0.064 | 1.55 | 0.30 | 7.10 | 14.75 | 0.90 | 0.47 | 0.024 | 0.012 | 40.01 | 2.49 | 177 | 76.9 | 113 |
| | 9 | 0.065 | 1.45 | 0.29 | 6.71 | 14.58 | 0.62 | 0.26 | 0.022 | 0.011 | 41.24 | 2.50 | 123 | 111.0 | 132 |
| | 10 | 0.034 | 1.49 | 0.32 | 7.45 | 15.05 | 1.30 | 0.41 | 0.020 | 0.012 | 39.96 | 2.33 | 187 | 94.1 | 105 |
| Control | 11 | 0.075 | 1.53 | 0.52 | 7.70 | 15.00 | 0.50 | 0.29 | 0.024 | 0.012 | 42.70 | 2.25 | 124 | 4.7 | 95.9 |
| | 12 | 0.063 | 0.96 | 0.32 | 6.50 | 14.43 | 0.52 | 0.22 | 0.018 | 0.009 | 41.51 | 2.43 | 87 | 149.4 | 143.6 |
| | 13 | 0.035 | 1.50 | 0.32 | 7.10 | 14.70 | 0.55 | 0.70 | 0.024 | 0.012 | 38.27 | 2.61 | 232 | 128.1 | 137.3 |
| | 14 | 0.036 | 1.49 | 0.32 | 7.44 | 14.94 | 1.08 | 0.57 | 0.020 | 0.009 | 39.38 | 2.41 | 217 | 100.9 | 112.2 |
| | 15 | 0.010 | 1.54 | 0.33 | 7.51 | 14.81 | 1.09 | 0.31 | 0.028 | 0.014 | 38.86 | 2.27 | 180 | 135.4 | 124.2 |
| | 16 | 0.006 | 1.59 | 0.35 | 7.66 | 14.89 | 0.95 | 0.41 | 0.028 | 0.013 | 38.66 | 2.30 | 204 | 129.1 | 125.1 |
| | 17 | 0.010 | 1.08 | 0.28 | 7.63 | 15.03 | 1.07 | 0.33 | 0.020 | 0.010 | 39.03 | 2.20 | 159 | 140.0 | 121.4 |
| | 18 | 0.007 | 1.55 | 0.32 | 7.49 | 14.93 | 1.08 | 0.36 | 0.026 | 0.018 | 38.68 | 2.32 | 188 | 130.0 | 123.5 |
| | 19 | 0.010 | 1.54 | 0.30 | 7.30 | 14.97 | 1.05 | 0.48 | 0.021 | 0.011 | 38.50 | 2.44 | 215 | 147.5 | 128.9 |
| | A (SUS301) | 0.096 | 0.51 | 1.04 | 6.96 | 16.72 | 0.06 | — | 0.020 | 0.010 | not calc'd | not calc'd | not calc'd | −42.3 | 80.3 |
| | B (17-7PH) | 0.071 | 0.44 | 0.51 | 7.24 | 16.73 | 0.08 | 0.09 | 1.18 | 0.021 | not calc'd | not calc'd | not calc'd | −16.9 | 91.5 |

TABLE 4

| Sp. No | C | Si | Mn | S | Ni | Cr | Cu | N | Md(N) | ΔHv | Amount of Martensite | NTS/TS | Ms (°C.) | A' Value | Remarkes | |
|---|---|---|---|---|---|---|---|---|---|---|---|---|---|---|---|---|
| 1 | 0.060 | 1.22 | 0.32 | 0.002 | 6.53 | 16.46 | 1.79 | 0.062 | 63 | 74 | 55 | 1.07 | −27.6 | 89.8 | | X |
| 2 | 0.062 | 2.32 | 0.92 | 0.003 | 5.23 | 15.48 | 1.81 | 0.055 | 97 | 108 | 87 | 1.00 | +50 | 90.0 | | X |
| 3 | 0.030 | 1.41 | 0.20 | 0.002 | 6.56 | 16.52 | 1.79 | 0.112 | 63 | 81 | 58 | 1.07 | −66 | 64.4 | | X |
| 4 | 0.060 | 2.64 | 0.43 | 0.003 | 7.66 | 15.86 | 1.64 | 0.086 | 38 | 78 | 43 | 1.10 | −54.7 | 90.6 | | O |
| 5 | 0.059 | 2.72 | 0.42 | 0.001 | 6.56 | 15.97 | 1.74 | 0.099 | 56 | 92 | 58 | 1.12 | −114 | 88.8 | H2 | O |
| 6 | 0.073 | 2.54 | 0.53 | 0.003 | 5.35 | 15.13 | 1.71 | 0.054 | 103 | 105 | 95 | 0.80 | +47.9 | 99.0 | | O |
| 7 | 0.106 | 2.58 | 1.04 | 0.004 | 6.96 | 16.30 | 1.79 | 0.019 | 30 | 48 | 29 | 1.12 | −114 | 129.7 | | X |
| 8 | 0.028 | 2.67 | 0.46 | 0.003 | 6.50 | 15.88 | 1.75 | 0.103 | 73 | 101 | 72 | 1.10 | −61.6 | 62.3 | H1 | O |
| 9 | 0.073 | 2.77 | 1.04 | 0.007 | 5.41 | 15.60 | 1.94 | 0.056 | 78 | 95 | 65 | 1.05 | −2.1 | 99.9 | | X |
| 10 | 0.065 | 1.42 | 0.35 | 0.003 | 7.32 | 16.20 | 0.98 | 0.096 | 56 | 64 | 47 | 1.08 | −136.6 | 94.1 | | X |
| 11 | 0.075 | 2.49 | 0.22 | 0.002 | 5.93 | 15.80 | 2.43 | 0.125 | 43 | 105 | 40 | 1.08 | −125.4 | 102.0 | H3 | O |
| 12 | 0.037 | 2.01 | 0.42 | 0.005 | 7.96 | 15.30 | 0.91 | 0.061 | 80 | 67 | 76 | 1.05 | −51.9 | 70.4 | | O |
| 13 | 0.066 | 2.83 | 1.54 | 0.008 | 6.12 | 16.64 | 2.07 | 0.110 | 21.5 | 45 | 20 | 1.10 | −185.4 | 75.7 | | X |
| 14 | 0.074 | 2.78 | 1.47 | 0.008 | 5.56 | 15.43 | 1.92 | 0.061 | 69.5 | 99 | 56 | 1.00 | −28.8 | 101.1 | E | X |

O: invention steel,
X: similar steel

FIG. 5 shows the relation between ΔHv and Md(N). FIG. 5 tells that under the Md(N) value of 35, the hardness increased by aging is insufficient. From the results shown in FIGS. 3, 4 and 5, it is understood that when the Md(N) value is between 35 and 95, the aged steel materials have good combination of hardness and ductility.

As has been described above, the steel of this invention is superior to known work-hardenable austenitic stainless steels and precipitation hardenable stainless steels in strength and ductility. The amounts of Mn, S, Ti, and Al, which form undesirable non-metallic inclusions, are carefully restricted and controlled, and in their stead, Cu, which does not produce undesirable inclusions, is added in a proper amount. This does not impair good surface smoothness, which is a characteristic of stainless steels. The steel is inexpensive since it does not contain no expensive elements.

We claim:

1. A high strength stainless steel essentially consisting of not more than 0.10% C, more than 1.5% and not more than 2.95% Si, less than 0.5% Mn, not less than 4.0% and not more than 8.0% Ni, not less than 12.0% and not more than 18.0% Cr, not less than 0.5% and not more than 3.5% Cu, not more than 0.15% N and not more than 0.004% S, wherein the total content of C and N is not less than 0.10% the balance being Fe and incidental impurities including up to 0.020% Al and up to 0.020% Ti, and the A' value (%) as defined below is not less than 42 and the Md(N) as defined below is 35–95

$$A'(\%) = 17 \times (C\,\%/Ti\,\%) + 0.70 \times (Mn\,\%) + 1 \times$$

-continued $$-(Ni\,\%) + 0.60 \times (Cr\,\%) + 0.76 \times (Cu\,\%) - 0.63 \times (Al\,\%) + 20.871$$

$$Md(N) = 580 - 520\,(C\,\%) - 2\,(Si\,\%) - 16\,(Mn\,\%) - 16\,(Cr\,\%) - 23\,(Ni\,\%) - 300\,(N\,\%) - 26\,(Cu\,\%)$$

2. The high strength stainless steel as claimed in claim 1, wherein the C content is not more than 0.08%, the Si content is not less than 1.5% and not more than 2.95%, the Mn content is less than 0.45%, the Ni content is not less than 4.5% and not more than 7.5%, the Cr content is not less than 14.0% and not more than 17.0%, the Cu content is not less than 0.8% and not more than 3.0%, the N content is not more than 0.13% and the S content is not more than 0.0035%.

3. The high strength stainless steel as claimed in claim 2, wherein the C content is not more than 0.075%, the Si content is not less than 1.5% and not more than 2.95%, the Mn content is less than 0.42%, the Ni content is not less than 5.50% and not more than 7.30%, the Cr content is not less than 14.5% and not more than 16.5%, the Cu content is not less than 1.00% and not more than 2.65%, the N content is not more than 0.125% and the S content is not more than 0.0030%.

* * * * *

UNITED STATES PATENT AND TRADEMARK OFFICE

CERTIFICATE OF CORRECTION

PATENT NO. : 4,849,166

DATED : July 18, 1989

INVENTOR(S) : Kazuo Hoshino, Sadao Hirotsu and Sadayuki Nakamura

It is certified that error appears in the above-identified patent and that said Letters Patent is hereby corrected as shown below:

Column 1 Line 61 "tbe" should read --the--.

Column 2 Line 37 "contained" should read --containing--.

Column 2 Line 61 "of" should read --by--.

Table 1 under Conventional Steels Line B "-161.23" should read -- -161.3--.

Table 3 under Steels of U.S. Pat. No. 4,378,246 Line 7 "120" should read --130--.

Claim 2 Line 13 Column 12 "0.45%" should read --0.46%--.

Signed and Sealed this

Nineteenth Day of June, 1990

*Attest:*

HARRY F. MANBECK, JR.

*Attesting Officer*

*Commissioner of Patents and Trademarks*